US009027579B2

(12) United States Patent
Binder et al.

(10) Patent No.: US 9,027,579 B2
(45) Date of Patent: May 12, 2015

(54) SURFACE CLEANING HEAD

(75) Inventors: Juergen Binder, Leutenbach (DE); Vitali Fischer, Backnang (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 285 days.

(21) Appl. No.: 13/358,770

(22) Filed: Jan. 26, 2012

(65) Prior Publication Data

US 2013/0019911 A1 Jan. 24, 2013

Related U.S. Application Data

(63) Continuation of application No. PCT/EP2009/060633, filed on Aug. 17, 2009.

(51) Int. Cl.

| | |
|---|---|
| ***A47L 13/10*** | (2006.01) |
| ***A47L 11/00*** | (2006.01) |
| ***B08B 3/02*** | (2006.01) |

(52) U.S. Cl.

CPC *A47L 11/00* (2013.01); *B08B 3/024* (2013.01)

(58) Field of Classification Search

CPC ..... A47L 11/00

See application file for complete search history.

(56) References Cited

U.S. PATENT DOCUMENTS

| | | | | |
|---|---|---|---|---|
| 3,748,050 A * | 7/1973 | Poppitz | ..... | 401/289 |
| 3,832,069 A | 8/1974 | Petsch | | |

FOREIGN PATENT DOCUMENTS

| | | | | |
|---|---|---|---|---|
| DE | 25 48 432 | 5/1976 | | |
| DE | 202 10 073 | 10/2002 | | |
| DE | 20210073 U1 * | 10/2002 | ..... | B08B 3/02 |
| WO | WO 02/102527 | 12/2002 | | |
| WO | WO02/102527 A1 * | 12/2002 | ..... | B08B 7/04 |

* cited by examiner

*Primary Examiner* — Michael Barr
*Assistant Examiner* — Jason Riggleman
(74) *Attorney, Agent, or Firm* — Lipsitz & McAllister, LLC

(57) ABSTRACT

A surface cleaning head is provided comprising a dome-shaped, downwardly open housing, in which at least one spray arm is mounted for rotation about an axis of rotation, wherein the spray arm bears at a distance from the axis of rotation a nozzle which can be acted upon with cleaning fluid subject to pressure and revolves around the axis of rotation together with the spray arm, and comprising a protective disk which covers the at least one spray arm towards the open underside of the housing and defines a ring-shaped fluid passage for a stream of fluid to pass through, said fluid passage being penetrated by retaining bars, wherein the at least one spray arm is rotatable relative to the protective disk. The retaining bars are arranged so as to be distributed unevenly in circumferential direction.

13 Claims, 7 Drawing Sheets

SURFACE CLEANING HEAD

This application is a continuation of international application number PCT/EP2009/060633 filed on Aug. 17, 2009.

The present disclosure relates to the subject matter disclosed in international application number PCT/EP2009/060633 of Aug. 17, 2009, which is incorporated herein by reference in its entirety and for all purposes.

BACKGROUND OF THE INVENTION

The invention relates to a surface cleaning head for cleaning a surface, comprising a dome-shaped, downwardly open housing, in which at least one spray arm is mounted for rotation about an axis of rotation, wherein the spray arm bears at a distance from the axis of rotation a nozzle which is adapted to be acted upon with cleaning fluid subject to pressure and to revolve around the axis of rotation together with the spray arm for the purpose of acting on the surface to be cleaned with a stream of fluid, and comprising a protective disk which covers the at least one spray arm towards the open underside of the housing and defines a ring-shaped fluid passage for the stream of fluid to pass through, this fluid passage being penetrated by retaining bars, wherein the at least one spray arm is rotatable relative to the protective disk.

Such a surface cleaning head is known from U.S. Pat. No. 3,832,069. It is suitable, for example, for the cleaning of hard surfaces, for example the surfaces of terraces, garage entrances and also garage doors. The pressure line of a high-pressure cleaning device can be connected to the surface cleaning head for the purpose of cleaning the hard surfaces. Cleaning fluid subject to pressure can then be supplied to the nozzle which is arranged on the at least one spray arm. The cleaning fluid can be applied to the surface to be cleaned with the aid of the nozzle. The nozzle thereby experiences a recoil, under the influence of which the spray arm is caused to rotate about the axis of rotation. This makes it possible to act on a relatively large surface area with cleaning fluid within a short time.

In order to prevent objects arranged on the surface to be cleaned, for example pebbles, reaching the area of the at least one spray arm, a protective disk is arranged beneath the spray arm in the case of the surface cleaning head known from U.S. Pat. No. 3,832,069. This defines a fluid passage so that the stream of fluid proceeding from the nozzle can reach the surface to be cleaned. The fluid passage is penetrated by several retaining bars which extend as far as a side wall of the housing and, as a result, stabilize the protective disk.

The stream of fluid rotating about the axis of rotation impinges at time intervals on a retaining bar which penetrates the fluid passage. As a result, the protective disk is caused to oscillate and this leads to a clearly audible noise.

The object of the present invention is to develop a surface cleaning head of the generic type further in such a manner that it generates less noise.

SUMMARY OF THE INVENTION

This object is accomplished in accordance with the invention, in a surface cleaning head of the generic type, in that the retaining bars are arranged so as to be distributed unevenly in circumferential direction.

The retaining bars penetrating the fluid passage are arranged so as to be distributed unevenly in circumferential direction in the case of the surface cleaning head according to the invention. As a result, the stream of fluid proceeding from the nozzle impinges on a retaining bar at irregular time intervals. On account of the action on adjacent retaining bars with fluid subject to pressure at irregular time intervals, no oscillating resonance can occur in the case of the protective disk and this, in turn, results in the generation of noise in the surface cleaning head according to the invention being relatively low.

In order to intensify the cleaning action, two spray arms which are located diametrically opposite one another are mounted in the housing for rotation about the axis of rotation and each bear a nozzle at a distance from the axis of rotation in one advantageous embodiment of the surface cleaning head according to the invention. As a result, a first stream of fluid and a second stream of fluid, which revolve around the axis of rotation and are arranged so as to be offset relative to one another through 180° in circumferential direction, can be directed onto the surface to be cleaned at the same time. It is favorable with such a configuration when the retaining bars are not located diametrically opposite one another in pairs since, as a result, it is ensured that the two streams of fluid do not impinge on a retaining bar at the same time but rather the second stream of fluid passes unhindered through the fluid passage when the first stream of fluid impinges on a retaining bar. It has been shown that, as a result, the generation of noise can also be kept low when two spray arms, which are located diametrically opposite one another, are used.

Preferably, an uneven number of retaining bars are used, for example three, five, seven or nine retaining bars can be provided which are arranged so as to be distributed unevenly in circumferential direction.

The retaining bars are preferably aligned radially to the axis of rotation of the spray arms.

In one advantageous embodiment of the invention, the protective disk forms a central protective shield which is arranged beneath the at least one spray arm and is connected via the retaining bars to a retaining ring which surrounds the protective shield in circumferential direction. It has been shown that the central protective shield can be stabilized mechanically by the use of the retaining ring, above all in its outer edge area bordering on the fluid passage.

In order to kept the weight of the protective shield and, therefore, the mechanical load on the surface cleaning head low, it is of advantage when the protective shield has a plurality of openings.

It may be provided, for example, for the protective shield to be of a grating-like or net-like configuration.

It is of particular advantage when the protective shield is connected to the retaining ring in one piece via the retaining bars. The protective shield can form a one-piece plastic molded part in combination with the retaining bars and the retaining ring.

The protective shield favorably comprises several reinforcing ribs which stabilize the protective shield mechanically.

At least some of the reinforcing ribs are preferably arranged in a radial direction in alignment with a retaining bar, via which the protective shield is connected to the outer retaining ring.

It is favorable when the reinforcing ribs project from the protective shield on the upper side and/or the lower side. This increases the stabilizing effect of the reinforcing ribs.

It is particularly advantageous when the height of the reinforcing ribs increases or decreases with increasing radial distance relative to the axis of rotation. The reinforcing ribs extend transversely to the protective shield, wherein their height varies as a function of the radial distance relative to the axis of rotation. It may be provided, in particular, for the height of the reinforcing ribs to increase or decrease continuously with increasing distance relative to the axis of rotation.

It has proven to be advantageous when the areas of the reinforcing ribs which project upwards or downwards from the protective shield form a triangular shape with respect to a radial plane.

It may, for example, be provided for all the reinforcing ribs to have both a reinforcing section projecting upwards from the protective shield and a reinforcing section projecting downwards from the protective shield, wherein the height of one of the two reinforcing sections, preferably the height of the upper reinforcing section, decreases continuously with increasing radial distance in the same manner as the height of the other reinforcing section, preferably the lower reinforcing section, increases with increasing radial distance.

The reinforcing ribs form a mechanical reinforcement of the protective shield. The latter is preferably produced as a plastic molded part in an injection molding process. During the injection molding process the reinforcing sections which project upwards or downwards from the protective shield represent flow channels which ensure that sufficient plastic material can flow as far as the outer edge areas of the injection mold. The reinforcing ribs therefore have an injection molding function in addition to their reinforcing function.

The retaining ring can be arranged on the housing of the surface cleaning head. It can, in particular, be provided for an edge section of the housing to form the retaining ring.

In one preferred embodiment, the retaining ring is arranged at a distance from the housing. The distance of the retaining ring from the housing in a radial direction is preferably less than the radial extension of the fluid passage.

It is of particular advantage when the retaining ring has, in an axial direction in relation to the axis of rotation of the at least one spray arm, an upper end area which is arranged within the housing and a lower end area which protrudes beyond the lower edge of the housing. The upper end area of the retaining ring is therefore surrounded by the housing in circumferential direction. As a result, the housing can form a guide for the retaining ring during the assembly of the protective disk in that the protective disk, the outer edge area of which is formed by the retaining ring, will be inserted into the housing from below. The lower end area of the retaining ring can protrude out of the housing in an axial direction. The retaining ring can, as a result, form an impact protection which protects the housing from damage when the surface cleaning head comes unintentionally close to the surface to be cleaned since the retaining ring with its axially protruding area touches the surface to be cleaned during any such closeness before the housing can impact on the surface.

It is particularly advantageous when a flexible spray protection element is arranged at the lower edge of the housing and projects in an axial direction beyond the lower edge of the retaining ring. A rubber lip or a ring of bristles can be used, for example, as flexible spray protection element. The flexible spray protection element therefore surrounds the lower end area of the retaining ring in circumferential direction and when the surface cleaning head is guided along on the surface to be cleaned the spray protection element can touch the surface without the retaining ring coming into contact with the surface as a result.

The material thickness of the retaining ring is favorably less than its axial extension. The retaining ring therefore forms a type of tubular section or sleeve. The sleeve surrounds the central protective shield of the protective disk in circumferential direction and forms a mechanical stabilization.

The protective disk is, in one advantageous embodiment, held on a bearing shaft, on which the at least one spray arm is mounted for rotation. In this respect, it may be provided for the protective disk to be rotatable relative to the bearing shaft. Alternatively, the protective disk can be non-rotatably fixed in or on the housing, for example on the bearing shaft.

It may be provided for the surface cleaning head to have only nozzles which are each held on a spray arm rotating about the axis of rotation. These can be arranged in the region of the fluid passage of the protective disk so that the ends of the retaining bars which are located radially outwards are at a greater distance in relation to the axis of rotation than the nozzles.

However, it may also be provided for the surface cleaning head to comprise, in addition to nozzles which are held on a rotatable spray arm, at least one additional nozzle which is arranged so as to be radially offset in relation to the protective shield, i.e. is at a greater radial distance from the axis of rotation than the outer edge of the protective disk. The additional nozzle can be held non-rotatably in the housing and be used, for example, for the cleaning of corner areas of a surface.

The following description of preferred embodiments of the invention serves to explain the invention in greater detail in conjunction with the drawings.

DETAILED DESCRIPTION OF THE INVENTION

Figure 1:
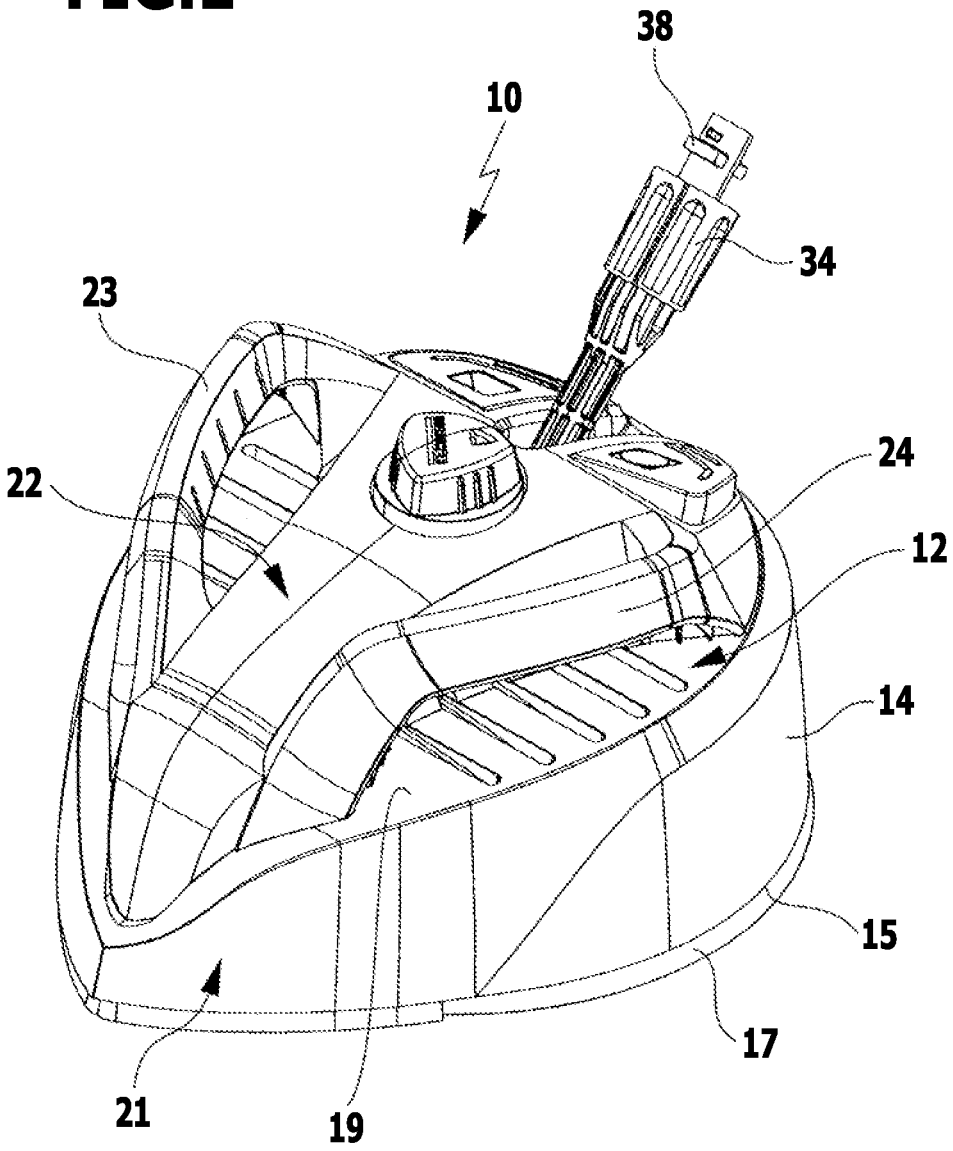
FIG. 1: shows a perspective illustration of a first embodiment of a surface cleaning head according to the invention.

A first embodiment of a surface cleaning head according to the invention, which is given altogether the reference numeral 10, is illustrated in FIGS. 1 to 5. This comprises a dome-shaped, downwardly open housing 12 with a closed cylinder wall 14 which is of a circular shape in the plan view and has at its lower edge 15 a circumferential flexible spray protection in the form of a ring of bristles 17. The cylinder wall 14 is covered by an upper wall 19. On the outer side, an attachment part 21 which is essentially V-shaped in the plan view is attached to the cylinder wall 14 and a cover 22 covering the upper wall 19 in a central area adjoins the attachment part above the upper wall 19. A first handle 23 and a second handle 24 are arranged above the upper wall 19 laterally to the cover 22 and can be gripped by the user for the purpose of carrying the surface cleaning head 10.

The cover 22 defines a distribution chamber 26 above the upper wall 19 and the cylinder wall 14 surrounds a spray chamber 28 beneath the upper wall 19. The attachment part 21 defines an additional chamber 30.

A central distributor part 32 is arranged in the distribution chamber 26 and has a supply pipe 34 opening into it which is mounted in the distributor part 32 so as to be pivotable about a pivot axis 36 aligned transversely to the longitudinal axis 35 of the pipe. At its free end facing away from the distributor part 32, the supply pipe 34 has a connecting element 38 so that a pressure line of a high-pressure cleaning device, which is known per se and not, therefore, illustrated in the drawings, can be connected to the supply pipe 34.

Figure 2:
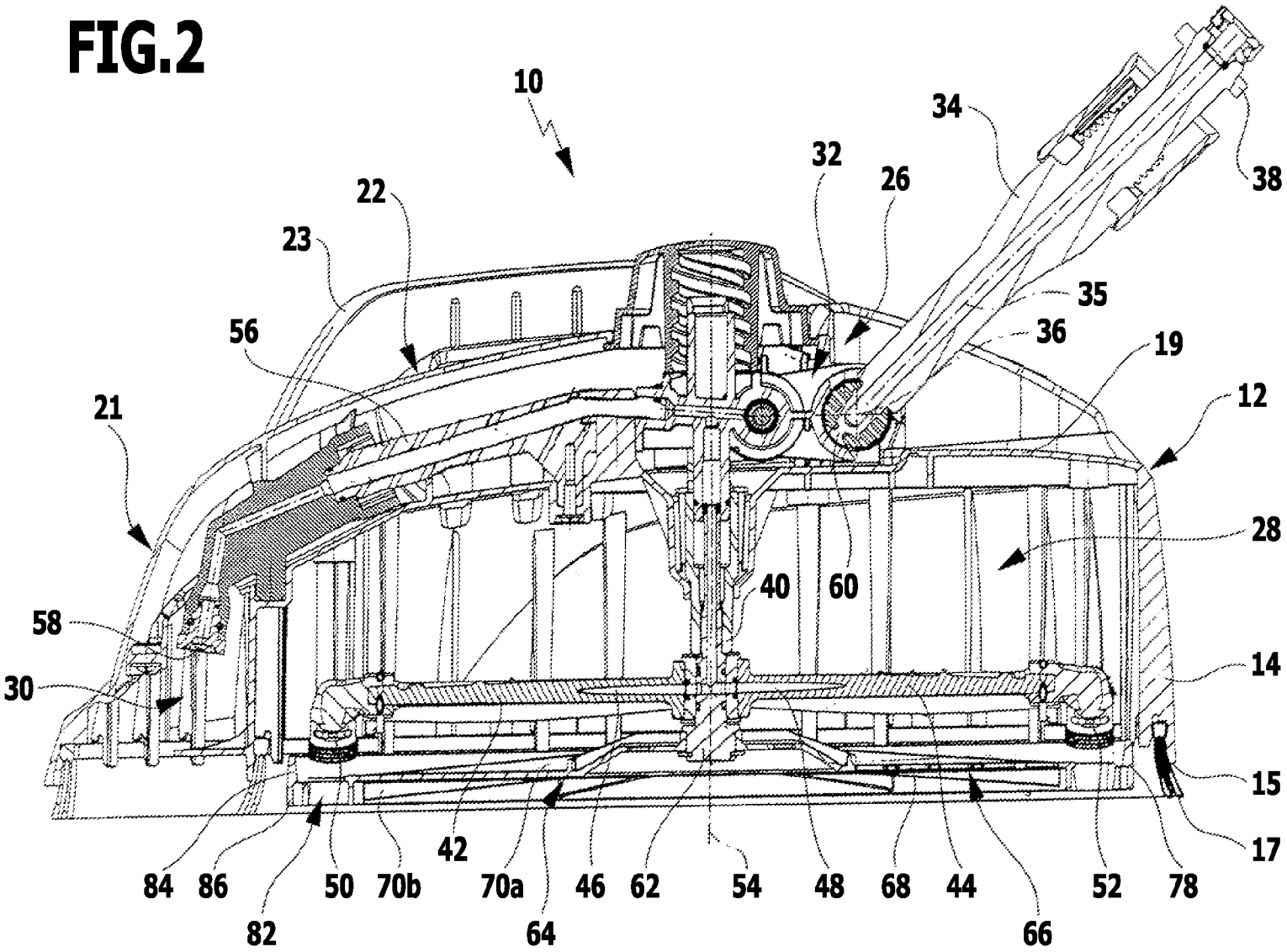
FIG. 2: shows a longitudinal sectional view of the surface cleaning head from FIG. 1.
Figure 3:
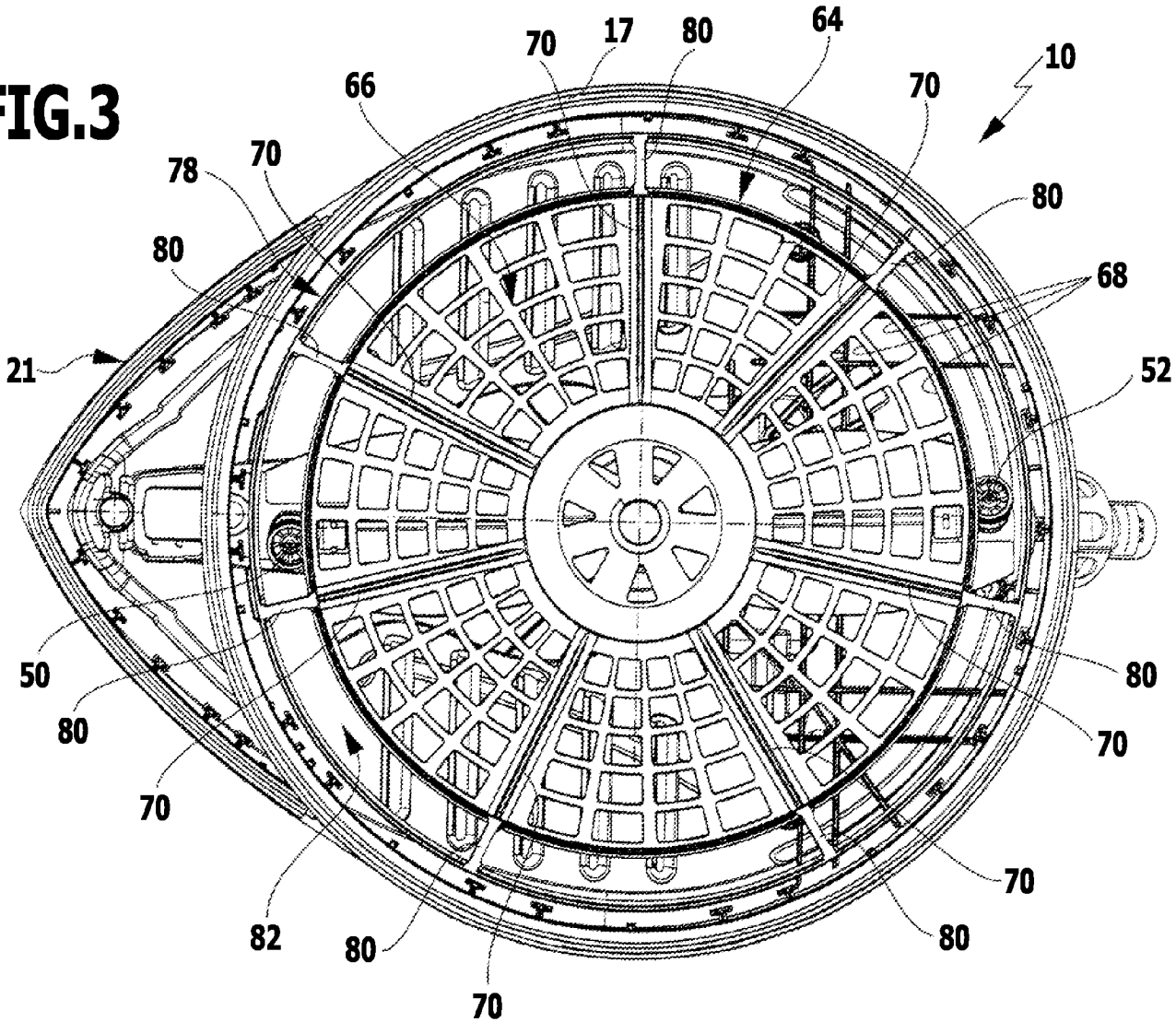
FIG. 3: shows a view of the underside of the surface cleaning head from FIG. 1.
Figure 4:
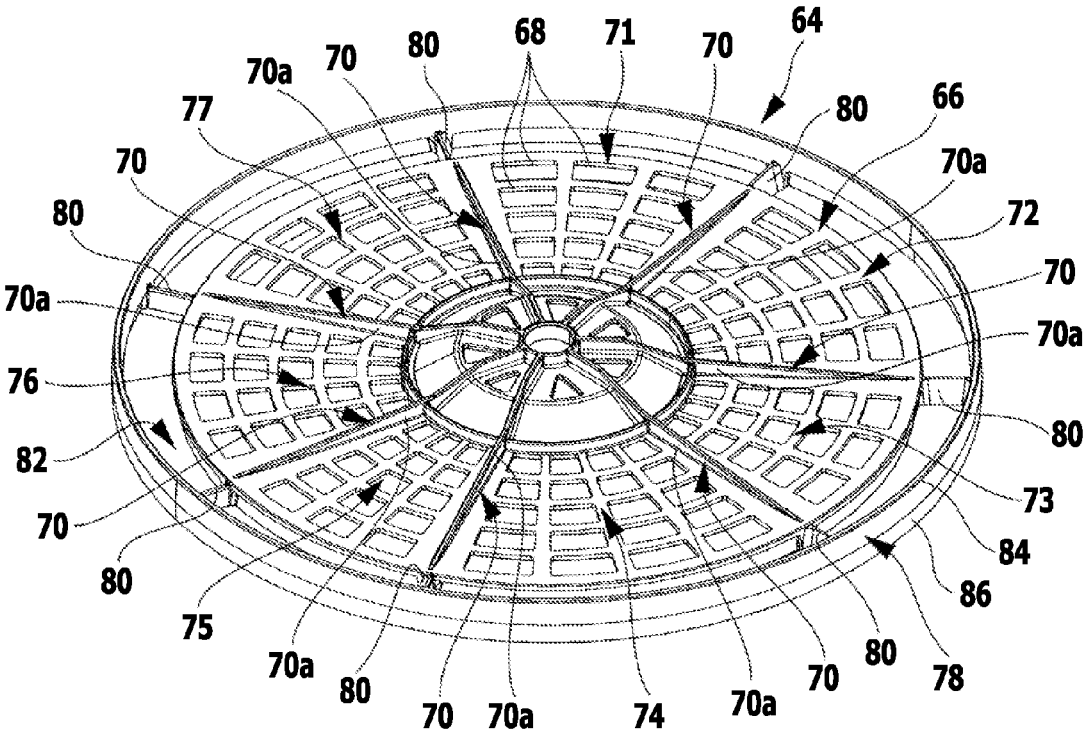
FIG. 4: shows a perspective illustration of a protective shield of the surface cleaning head from FIG. 1 at an angle from above.
Figure 5:
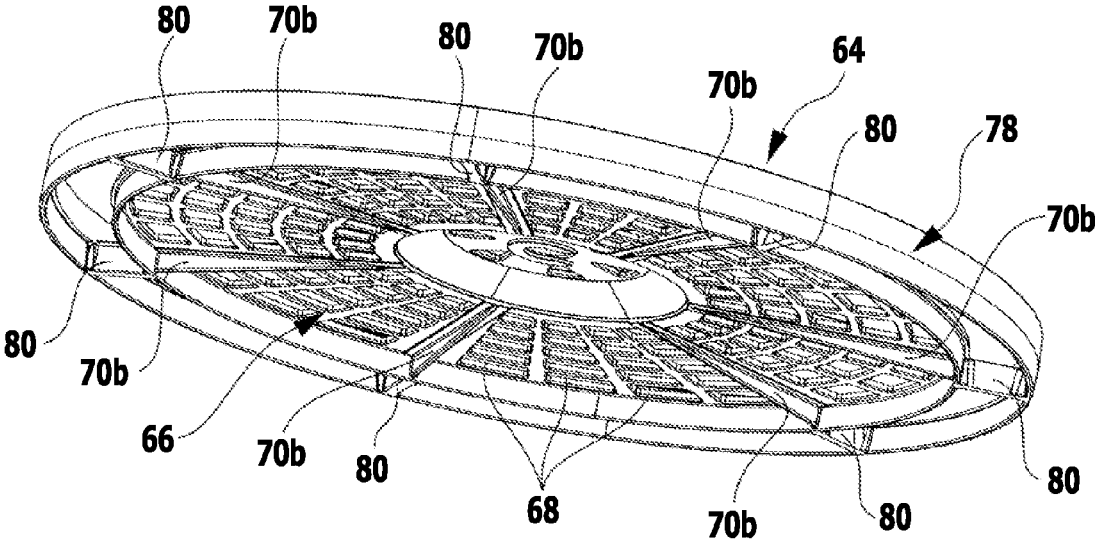
FIG. 5: shows a perspective illustration of the protective shield from FIG. 4 at an angle from below.

The central distributor part 32 is in flow communication via a first supply line 40 with two spray arms 42, 44 which are located diametrically opposite one another and each have a flow channel 46 and 48, respectively, and bear a nozzle 50 and 52, respectively, at their free ends. The flow channels 46, 48 extend through the spray arms 42 and 44, respectively. In FIG. 2, the flow channels 46, 48 are illustrated only partially. The nozzles 50, 52 can be acted upon with cleaning fluid subject to pressure via the supply pipe 34 and the distributor part 32 as well as the first supply line 40 adjoining the distributor part 32 and the flow channels 46 and 48 and generate a stream of cleaning fluid which is directed downwards at an angle. When they exit the nozzles 50, 52, the streams of fluid exert torque on the spray arms 42, 44 as a result of reaction forces and cause these to rotate about an axis of rotation 54 which is aligned coaxially to the longitudinal axis of the first supply line 40. As a result, a first stream of fluid and a second stream of fluid can be directed onto a surface to be cleaned by means of the revolving nozzles 50, 52.

A second supply line 56, which dips into the additional chamber 30 on the upper side and bears an additional nozzle 58 at its free end, extends within the distribution chamber 26, proceeding from the central distributor part 32. The additional nozzle 58 is designed in the form of a spray nozzle and is held stationarily in the housing 12 in contrast to the rotating nozzles 50, 52. Cleaning fluid subject to pressure can be discharged from the additional nozzle 58 for the purpose of, for example, cleaning a corner area of a surface to be cleaned.

The supply of cleaning fluid proceeding from the supply pipe 34 via the distributor part 32 is brought about selectively either only to the nozzles 50, 52 arranged on a respective spray arm 52, 54 or to the additional nozzle 58. For this purpose, the distributor part 32 has a switchover device 60 which is illustrated only schematically in the drawings and releases the flow path between the supply pipe 34 and the first supply line 40 in a first switching position and the flow path between the supply pipe 34 and the second supply line 56 in a second switching position.

The two spray arms 42, 44 are mounted for rotation on a bearing shaft 62 which is held at the first supply line 40 and has flow channels for the purpose of providing the flow connection between the first supply line 40 and the flow channels 46, 48 of the two spray arms 42, 44. In an axial direction, i.e. in the direction of the axis of rotation 54, the bearing shaft 62 projects downwards beyond the spray arms 42, 44. In its protruding area, the bearing shaft 62 bears a protection element in the form of a protective disk 64, the construction of which is apparent, in particular, from FIGS. 4 and 5. The protective disk 64 comprises a central, circular protective shield 66 which is of a grating-like configuration and has a plurality of openings 68. It is divided by radially extending reinforcing ribs 70 into several sectors 71 to 77 which extend in circumferential direction over a different respective angular area.

The reinforcing ribs 70 each have a reinforcing section 70*a* on the upper side and a reinforcing section 70*b* on the underside. The reinforcing section 70*a* on the upper side projects out of the protective shield 66 on the upper side, is, therefore, aligned at right angles to it, wherein its height decreases with increasing distance from the axis of rotation 54. The reinforcing section on the upper side forms a triangular shape in a radial plane. The reinforcing section 70*b* on the underside projects out of the protective shield 66 on the underside and is likewise aligned at right angles to it. The height of the reinforcing section on the underside increases with increasing distance from the axis of rotation 54 in the same way as the height of the reinforcing section 70*a* on the upper side decreases. The reinforcing section 70*b* on the underside also defines a triangular shape in a radial plane. The reinforcing ribs 70 form a mechanical reinforcement of the protective shield 66 with their reinforcing sections 70*a* and 70*b* on the upper and lower sides. The protective shield is produced from a plastic material by way of an injection molding process. During the injection molding process, the reinforcing sections represent flow channels for the fluid plastic material which ensure that sufficient plastic material can flow as far as the outer end areas of the injection mold.

In circumferential direction, the central protective shield 66 is surrounded by a retaining ring 78 which is connected in one piece to the protective shield 66 via retaining bars 80 which are arranged in alignment with the reinforcing ribs 70. A ring-shaped fluid passage 82, which is penetrated by the retaining bars 80, extends between the retaining ring 78 and the outer edge of the protective shield 66.

The retaining ring 78 is configured like a very short piece of pipe or like a sleeve in that its material thickness is considerably less than its extension in an axial direction in relation to the axis of rotation 54 of the spray arms 42, 44. An axial, upper end area 84 of the retaining ring 78 is arranged within the housing 12 in that it is surrounded in circumferential direction by the free end area of the cylinder wall 14, whereas an axial, lower end area 86 protrudes beyond the lower edge 15 of the cylinder wall 14 and, therefore, beyond the housing 12 downwards. The lower end area 86 is, however, surrounded in circumferential direction by the flexible spray protection, namely by the ring of bristles 17 which, for its part, projects in an axial direction downwards beyond the lower end area 86 of the retaining ring 78. This is apparent, in particular, from FIG. 2.

During the assembly of the surface cleaning head 10, the protective disk 64 can be inserted into the housing 12 from below. In this respect, the lower end area of the cylinder wall 14 forms a guide for the protective disk 64. Following assembly of the protective disk 64 on the bearing shaft 62, the ring-shaped fluid passage 82 is arranged in alignment with the nozzles 50 and 52 and so the streams of fluid proceeding from the nozzles 50, 52 can pass through the fluid passage 82 in order to act on the surface to be cleaned.

As already explained, the nozzles 50, 52 rotate about the axis of rotation 54 when they are acted upon with fluid subject to pressure. They each discharge a stream of fluid. While the nozzles 50, 52 are revolving around the axis of rotation 54, the respective stream of fluid impinges on a retaining bar 80 at irregular time intervals, wherein it is, however, ensured that two retaining bars cannot be acted upon at the same time by the two streams of fluid which proceed from the nozzles 50, 52. This is ensured by the fact that the retaining bars 80 are not aligned diametrically opposite one another in pairs, as is the case for the two spray arms 42, 44. At the moment a first stream of fluid impinges on one retaining bar 80, the second stream of fluid can pass unhindered through the fluid passage 82.

Since the retaining bars 80 are distributed unevenly in circumferential direction, the protective disk 64 cannot be caused to oscillate in a resonant manner by the circulating steams of fluid since the retaining bars 80 are acted upon by a stream of fluid at irregular time intervals. This uneven arrangement of the retaining bars ensures that the generation of noise by the surface cleaning head 10 can be kept low.

Figure 6:
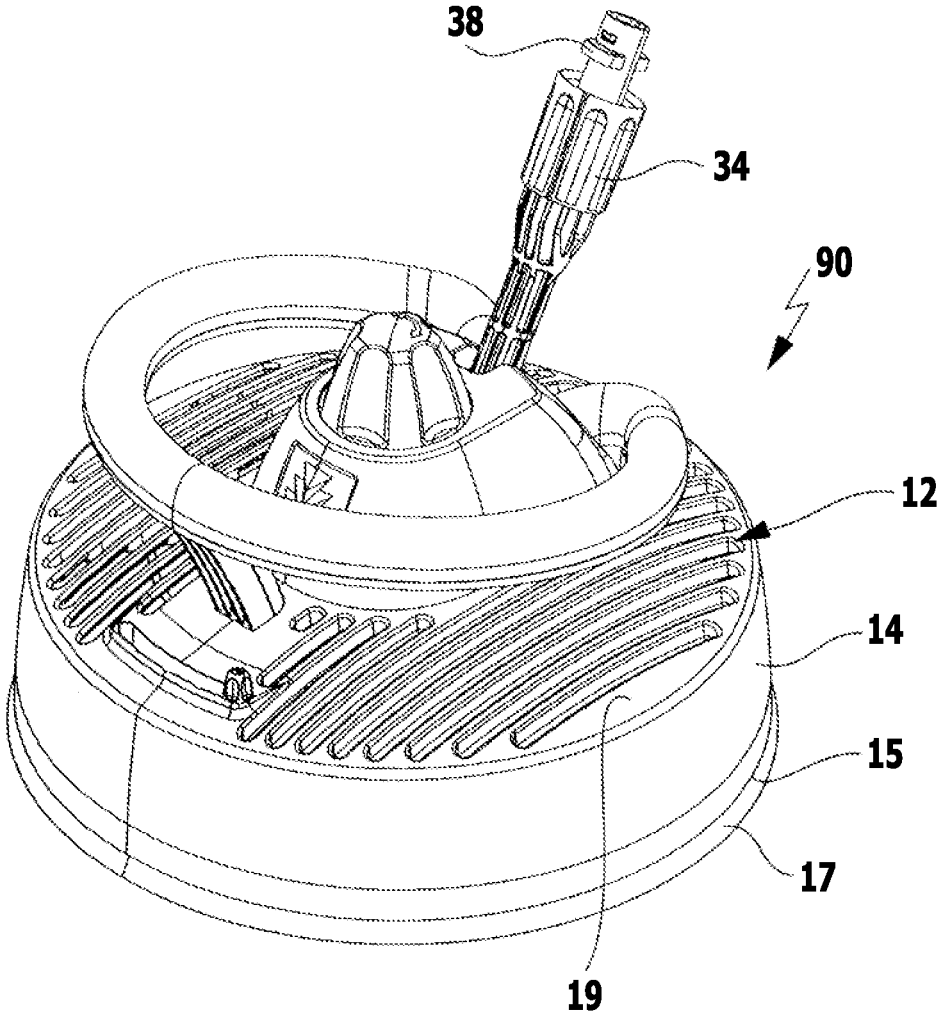
FIG. 6: shows a perspective illustration of a second embodiment of a surface cleaning head according to the invention
Figure 7:
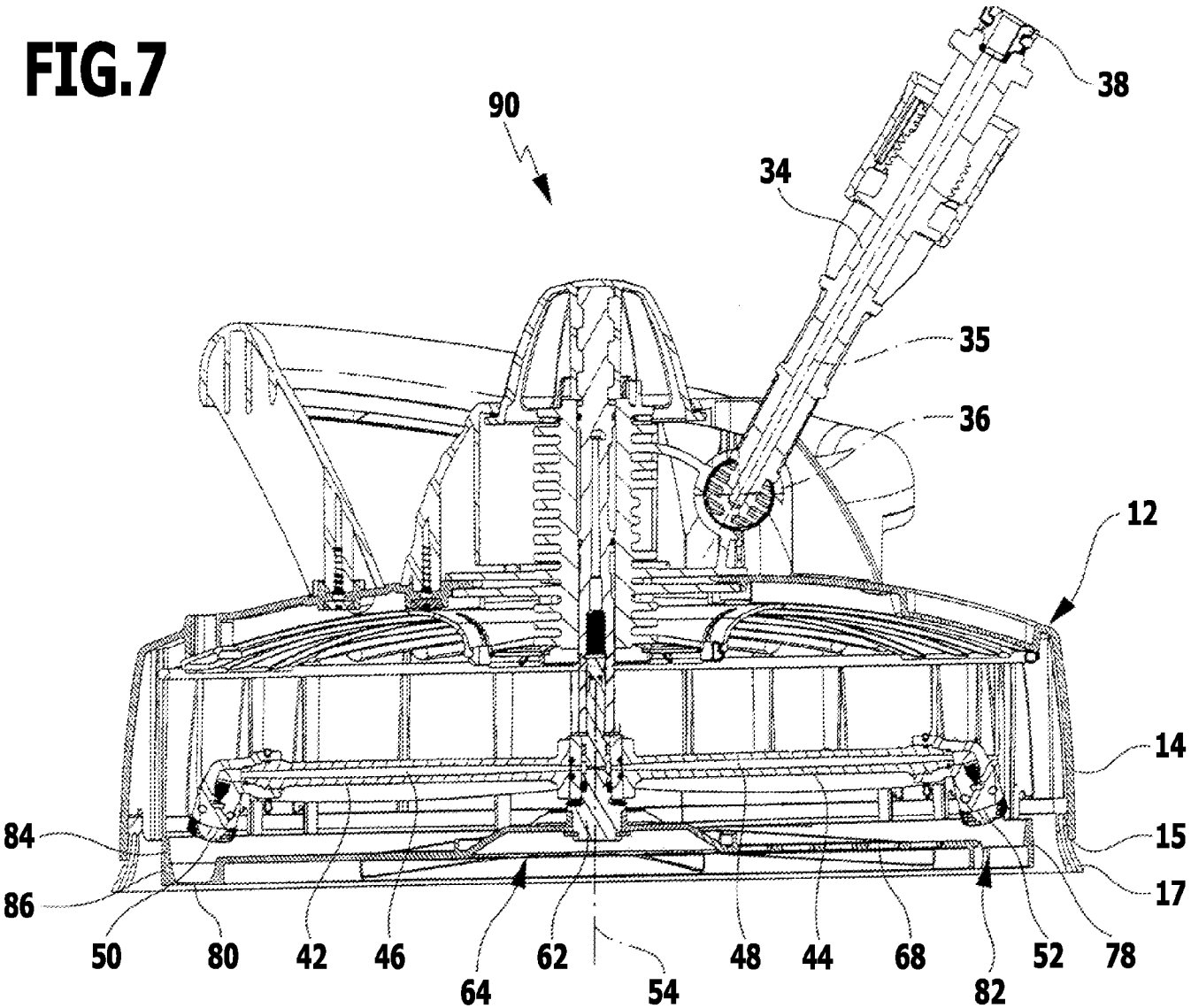
FIG. 7: shows a longitudinal sectional view of the surface cleaning head from FIG. 6.

A second configuration according to the invention of a surface cleaning head according to the invention is illustrated in FIGS. 6 and 7 and given, altogether, the reference numeral 90. The surface cleaning head 90 is to a large extent of an identical design to the surface cleaning head 10 explained above with reference to FIGS. 1 to 5. Therefore, the same reference numerals as in FIGS. 1 to 5 are used in FIGS. 6 and 7 for identical components and, to avoid any repetitions, reference is made to the preceding explanations with respect to these components.

The surface cleaning head 90 illustrated in FIGS. 6 and 7 differs from the surface cleaning head 10 explained above in that it has merely the two nozzles 50, 52 which are each held at the free end of a spray arm 42 and 44, respectively, and rotate about the axis of rotation 54 when acted upon with a cleaning fluid subject to pressure. A non-rotational additional nozzle is not used for the surface cleaning head 90.

The surface cleaning head 90 likewise has a protective disk 64, as has been explained above with reference to FIG. 4. The protective disk 64 has a central protective shield 66 which is surrounded in circumferential direction by a retaining ring 78, wherein a fluid passage 82 is arranged between the protective shield 66 and the retaining ring 78 and is penetrated by retaining bars 80, wherein the retaining bars 80 are arranged so as to be distributed unevenly in circumferential direction in the case of the surface cleaning head 90, as well. The uneven arrangement of the retaining bars 80 also ensures in the case of the surface cleaning head 90 that the generation of noise during action with cleaning fluid subject to pressure can be kept relatively low since a resonant oscillation of the protective disk 64 cannot occur due to the streams of fluid impinging on the retaining bars 80 in an irregular time sequence.

The invention claimed is:

1. Surface cleaning head for cleaning a surface, comprising:

a dome-shaped, downwardly open housing, at least one spray arm mounted in said housing for rotation about an axis of rotation, the at least one spray arm bearing a nozzle at a distance from the axis of rotation, said nozzle being adapted to be acted upon with cleaning fluid subject to pressure and to revolve around the axis of rotation together with the spray arm for the purpose of acting on a surface to be cleaned with a stream of fluid, and a protective disk covering the at least one spray arm towards an open underside of the housing and defining a ring-shaped fluid passage for substantially all the stream of fluid to pass through, the protective disc comprising retaining bars extending through said passage and arranged at an uneven spacing in the passage, wherein:

a radius of the protective disc being at least equal to an overall length of the at least one spray arm and the nozzle, the at least one spray arm is rotatable relative to the protective disk, the protective disk is held on a bearing shaft, the at least one spray arm being mounted on said bearing shaft for rotation.

2. Surface cleaning head as defined in claim 1, wherein:

the at least one spray arm comprises two spray arms located diametrically opposite one another and mounted in the housing for rotation about the axis of rotation, said spray arms each bearing a nozzle at a distance from the axis of rotation, and the retaining bars are not located diametrically opposite one another.

3. Surface cleaning head as defined in claim 1, wherein the protective disk forms a central protective shield arranged beneath the at least one spray arm and connected via the retaining bars to a retaining ring surrounding the protective shield in the circumferential direction.

4. Surface cleaning head as defined in claim 3, wherein the protective shield has a plurality of openings.

5. Surface cleaning head as defined in claim 3, wherein the protective shield is of a grating-like or net-like configuration.

6. Surface cleaning head as defined in claim 3, wherein the protective shield is connected to the retaining ring in one piece via the retaining bars.

7. Surface cleaning head as defined in claim 3, wherein the protective disk has reinforcing ribs projecting from the protective shield on at least one of an upper side and an underside, said ribs extending in alignment with the retaining bars in a radial direction.

8. Surface cleaning head as defined in claim 7, wherein a height of the reinforcing ribs increases or decreases with increasing radial distance relative to the axis of rotation.

9. Surface cleaning head as defined in claim 7, wherein areas of the reinforcing ribs projecting upwards or downwards from the protective shield form a triangular shape with respect to a radial plane.

10. Surface cleaning head as defined in claim 3, wherein the retaining ring is arranged at a distance from the housing.

11. Surface cleaning head as defined in claim 3, wherein the retaining ring has in an axial direction in relation to the axis of rotation of the at least one spray arm an upper end area arranged within the housing and a lower end area projecting beyond a lower edge of the housing.

12. Surface cleaning head as defined in claim 11, wherein a flexible spray protection element is arranged at the lower edge of the housing and projects in the axial direction beyond the lower end area of the retaining ring.

13. Surface cleaning head as defined in claim 3, wherein a material thickness of the retaining ring is less than an axial extension of the retaining ring.

* * * * *